United States Patent [19]

Robertson

[11] Patent Number: 5,074,236

[45] Date of Patent: Dec. 24, 1991

[54] CANISTER CONTAINED EMERGENCY BOAT LADDER

[75] Inventor: Eric B. Robertson, Bradenton, Fla.

[73] Assignees: Mac Spenser; Jack Jawita, both of Bradenton, Fla.

[21] Appl. No.: 588,218

[22] Filed: Sep. 26, 1990

[51] Int. Cl.[5] ..... B63B 27/14

[52] U.S. Cl. ..... 114/362; 182/70; 182/196

[58] Field of Search ..... 114/343, 362, 364; 182/3, 4, 8, 62, 70, 74, 92, 93, 151, 189, 190, 196, 198, 199

[56] References Cited

U.S. PATENT DOCUMENTS

| | | | |
|---|---|---|---|
| 3,216,030 | 11/1965 | Garfield | 182/196 |
| 3,664,457 | 5/1972 | York | 182/70 |
| 4,164,991 | 8/1979 | Marra | 182/196 |
| 4,376,419 | 3/1983 | Heilskov | 114/362 |
| 4,383,592 | 5/1983 | Hoffa | 182/196 |
| 4,788,926 | 12/1988 | Ullman et al. | 114/362 |
| 4,811,817 | 3/1989 | Geary | 114/362 |

*Primary Examiner*—Jesûs D. Sotelo
*Assistant Examiner*—Stephen P. Avila
*Attorney, Agent, or Firm*—Browdy and Neimark

[57] ABSTRACT

An emergency ladder system in which a flexible ladder is contained in a separate canister includes a flexible leader which exits the canister and is attached separate from the canister to a strong fixture, such as a hook, eye or cleat in a boat railing. A lanyard hangs from the canister, and a pull on the lanyard by, for instance, a person overboard causes the canister to open and the ladder to fall into an emergency position away from the canister.

15 Claims, 2 Drawing Sheets

CANISTER CONTAINED EMERGENCY BOAT LADDER

FIELD OF THE INVENTION

The present invention relates to emergency ladders, and more particularly to a rope ladder which is stored in a canister and which can be quickly released for emergency use.

BACKGROUND OF THE INVENTION

Emergency ladders have been used for many years. Multi-storied buildings are sometimes equipped with emergency ladders of various types such as fire escapes. Boats may have emergency ladders to assist in returning a person overboard back onto the boat. Most of these ladders tend to be bulky one-piece rigid ladders which take up too much space.

Rope ladders are known, but are often stored away from where they are needed. Thus, in the situation where a person on a boat falls overboard and where there is no one on board the boat to get the rope ladder or any other safety device, the overboard person may have no way to reboard the boat. What is needed is an emergency ladder system which is compact and which is stored in an always convenient position accessible to the overboard person.

U.S. Pat. No. 4,788,926 overcomes some of the deficiencies of the earlier prior art by providing a combined boat fender or bumper and emergency rope ladder. The rope ladder is contained inside and is part of the fender, and when a person falls overboard he can pull on a handle which causes the bottom of the fender to drop down releasing a rope ladder for egress back onto the boat.

A major deficiency of the '926 bumper is that it is located outside the bounds of the vessel. Thus, it will not be available as an emergency ladder when the bumper is being used as a bumper. For instance, if the bumper is tight against an adjacent boat or a dock, there may be only 3 to 4 inches clearance, not enough for use of the emergency ladder.

If the bumper is dragged in the water such as when heeling while sailing, the ladder may inadvertently deploy.

The bumper is not a permanent installation and must be set in place for use. Safe boating practice dictates that no portable bumpers should be outside the bounds of a vessel when approaching a dock in order to prevent the bumper from getting caught on a piling or another boat. Thus, the bumper/ladder will not be available for emergency use at that time.

Moreover, if the bumper is inadvertently hung on a life line, as is common practice for most bumpers, it probably will not be secure enough for a person to climb aboard.

Also, the knot used to secure the bumper may not hold firmly against a person's weight. This latter problem becomes more clear when it is understood that the handle which must be activated to release the ladder from the bumper shell of U.S. Pat. No. '926 is likely to require significant force for disengagement.

In the bumper ladder system, the bumper is part of the ladder reboarding mechanism. Thus, the whole structure must be strong enough to support a person. This will require that every part of the structure be made of very strong and expensive materials.

SUMMARY OF THE INVENTION

It is an object of the present invention to overcome the problems and deficiencies of the prior art, such as those indicated above.

It is another object of the present invention to provide a flexible ladder which is stored in a canister and which can be released for emergency use.

It is a further object of the present invention to provide a means of egress back aboard a vessel for a person overboard.

It is still another object of the present invention to provide an egress for a man overboard which can be activated by the person who has fallen overboard.

It is still a further object of the present invention to provide an emergency ladder system for a boat which can be quickly and easily reset for reuse.

It is yet another object of the present invention to provide an emergency ladder system which can be mounted on the rail of any boat regardless of boat type or make.

It is yet a further object of the present invention to provide a ladder which can be used on a multi-storied home or other building as a fire escape.

It is another object of the present invention to provide a ladder and canister system in which the weight of the person climbing up or down the ladder is displaced away from the canister to a more strong and stable ladder anchoring location.

The above objects are accomplished by the use of a rope ladder stored in a canister, which ladder can be released from the canister for emergency use. A person overboard can pull down on a lanyard causing the canister to open by means of a quick release latch mechanism and the ladder to drop down into an emergency use position. The released ladder is supported at a position outside of and away from the canister so that the weight of person climbing the ladder can be adequately supported. Thus, while a lightweight plastic inexpensively produced canister can be used, the ladder anchor will be able to support virtually any user.

BRIEF DESCRIPTION OF THE DRAWINGS

Other objects, features and advantages of this invention will be more apparent from a consideration of the detailed description given below taken in conjunction with the accompanying drawings, in which.

DETAILED DESCRIPTION OF THE PREFERRED EMBODIMENT

Figure 1:
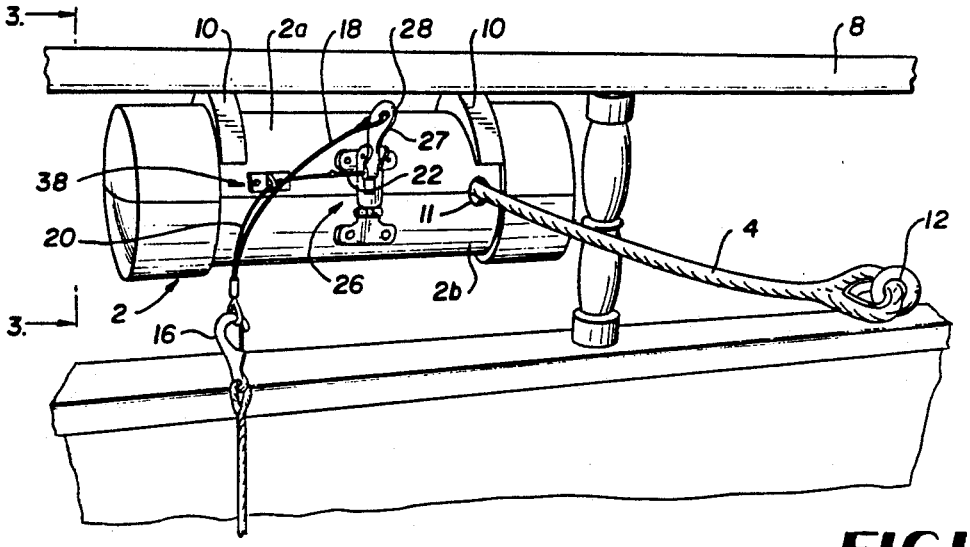
FIG. 1 is a front perspective view of a canister holding an emergency ladder in accordance with the present invention attached to a boat and held in the closed position.

A preferred embodiment of the present invention is shown in FIGS. 1–6. A canister 2, preferably made of a plastic material such as polyvinyl chloride, is shown in a closed position in FIG. 1. The canister 2 includes a top section 2a and a bottom section 2*b*. The canister 2 holds a ladder 6 made of suitable flexible material, preferably nylon rope.

The canister 2 is made to be permanently mounted on a boat railing 8 by means of a holder 10 so that the canister 2 does not extend outside the bounds of the vessel. At the upper end of the rope ladder 6 is a rope ladder leader 4 which is securely attached to the vessel at a position apart from the canister 2, such as by means of a permanent ring, hook, cleat or eye, e.g. ring 12 shown in FIGS. 1 and 2. The rope ladder leader 4 leaves the canister 2 through a hole 11.

Figure 2:
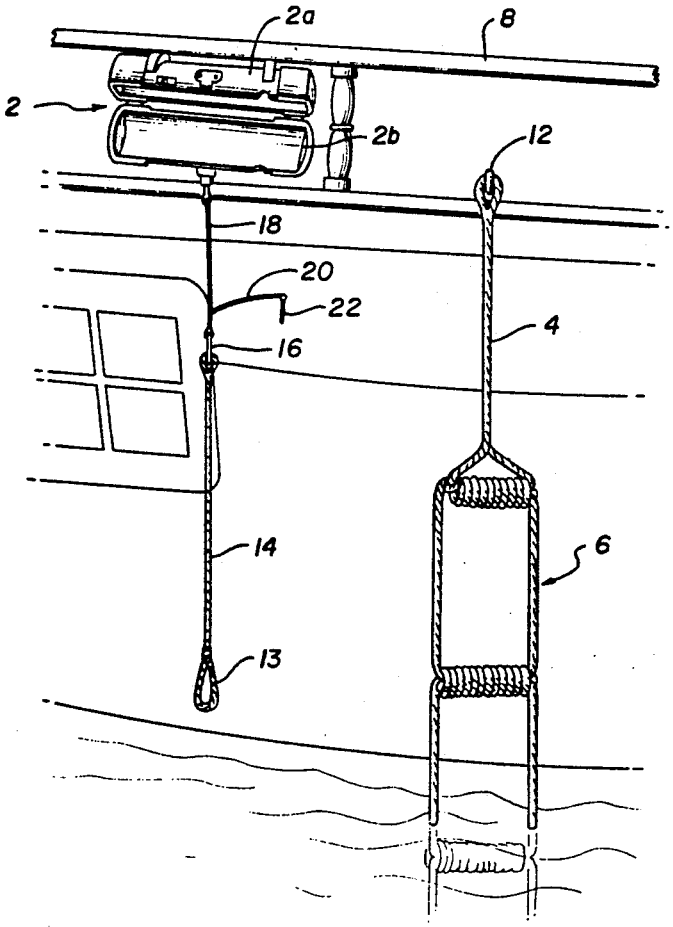
FIG. 2 is a front perspective view similar to FIG. 1 but with the emergency ladder deployed and the canister open.
Figure 3:
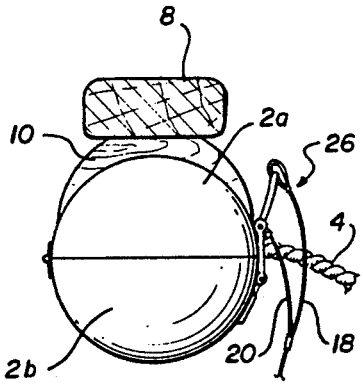
FIG. 3 is a partial sectional view along line 3—3 of FIG. 1 including an end view of the canister of FIGS. 1 and 2 in the closed position.
Figure 4:
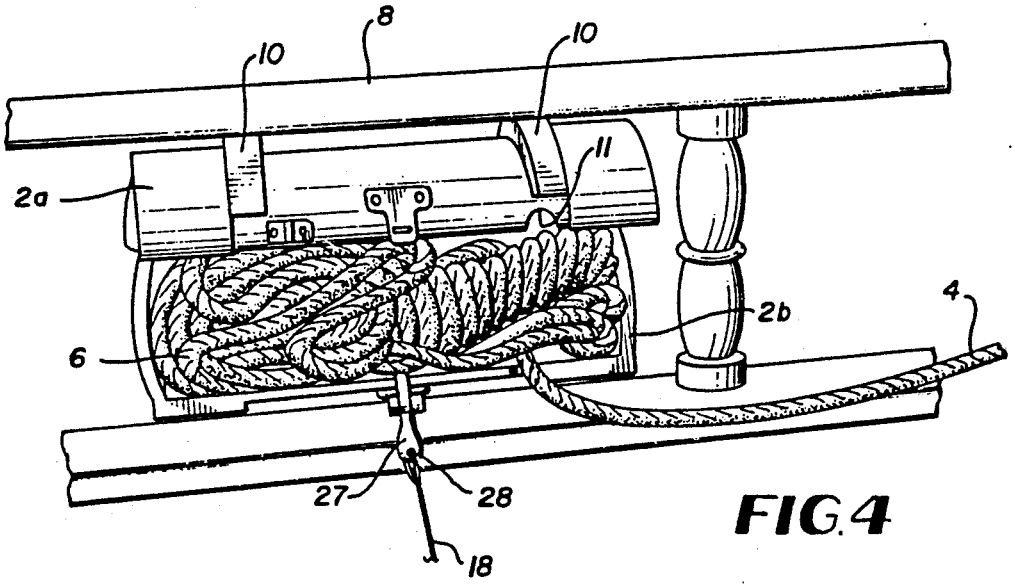
FIG. 4 is a front perspective view of the canister of FIG. 1–3 just as the canister has opened and the ladder is about to fall out of the canister.
Figure 5:
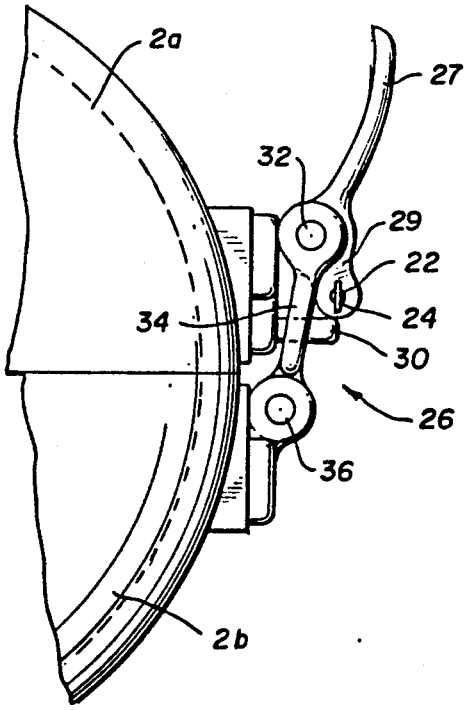
FIG. 5 is a close-up side view of an easy opening latch in the closed position which can be used to close the canister in accordance with the present invention.
Figure 6:
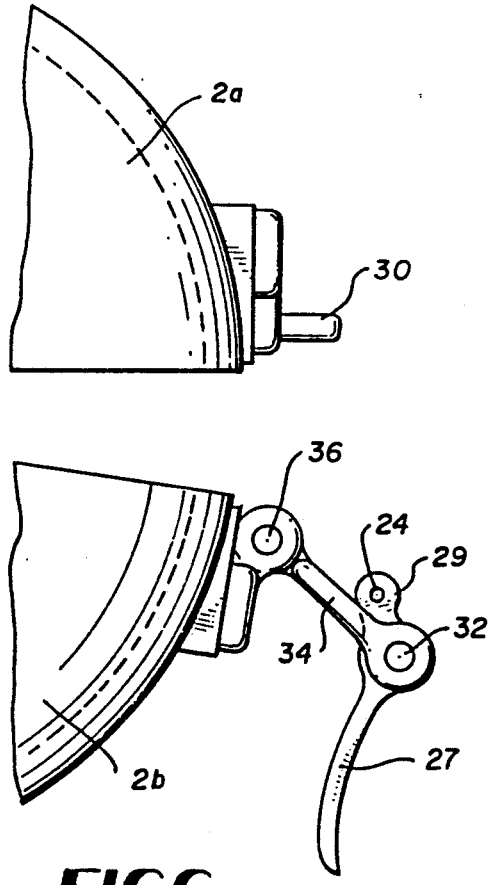
FIG. 6 is a close-up perspective view of the easy opening latch of FIG. 5 in the open position.

The cannister sections 2*a* and 2*b* are hingedly attached along a rear portion as shown in FIGS. 2 and 3 so that when the sections 2*a* and 2*b* are not latched together the bottom section 2*b* drops down as shown in FIGS. 2 and 4. A releasable latch 26 normally keeps the canister 2 closed as shown in FIGS. 1 and 5. Part of the latch 26 comprises a release handle 27 to which is connected, directly or indirectly, a grasping piece 13, as best seen in FIG. 2.

Thus, the grasping piece 13 hangs down near the water by means of a lanyard or rope 14 which is attached to a hook 16. Two lines 18 and 20 come off the hook 16 to the canister 2. Line 18 goes directly to a hole 28 in latch handle 26 while the pin line 20, ending at pin 22, goes through a pin line holder 38. Pin 22 is releasably held in hole 24 of a part 29 of the latch 26.

A latch retaining bar 30 in the top half 2a of the canister 2 holds the latch 26 in place in the closed position. Latch part 29 forms an extension of the latch handle 27 and these pivot as a unit about an axis piece or shaft 32 which in turn is held at the free end of a latch piece 34 which itself is pivotably supported on the bottom section 2*b* along an axis piece or shaft 36.

The operation of the exemplary illustrated emergency ladder canister system for use by an overboard swimmer is as follows:

The overboard swimmer can grab a hold of the grasping piece 13 and make a pulling down motion. This in turn pulls down lanyard 14. The resulting force on the hook 16 causes both the line 18 and the pin line 20 to be pulled down. The pin line holder 38 guides the pin line 20 in the horizontal direction causing the pin 22 to be pulled out of the hole 24. The downward force on line 18 pulls the handle 27 of the latch 26 down causing it to pivot about axis 32 and then causes latch piece 34 to rotate pivotably about axis 36 as latch part 29 is forced against the retaining bar 30. As the latch 26 clears the bar 30, the bottom half 2*b* of the canister is allowed to fall away from the top half 2a of the canister 2.

The rope ladder 6, having its rope leader 4 which leaves the canister 2 through the hole 11, is attached to a strong permanent part of the boat such as the hook 12. As the canister 2 opens, the rope ladder 6 falls out of the canister and into the water. FIG. 4 shows the canister just as it has opened and FIG. 2 shows the canister 2 and a ladder 6 after the ladder has fallen into the water.

It is very important, as shown for example in FIG. 2, to have the ladder 6 attached to a permanent mooring such as the hook 12, and not attached to the canister 2 because the canister 2, preferably made of a plastic material, will not have the same high strength as the hook 12 for supporting a person on the ladder.

When the emergency ladder system is in the position shown in FIG. 2, the person overboard can climb out of the water using ladder 6, and then the ladder can be pulled up, folded and put back into canister 2, and the canister 2 closed for reuse.

An important advantage of the present invention is that the latch system of the stored ladder may be opened by very little force. Yet there is very little chance of an inadvertent release. The canister 2 is fixed to a railing 8 located within the bounds of the vessel. Only the emergency pullrope, lanyard 14, is outside of the vessel bounds.

Another advantage of the present invention is that the canister 2 is available for use at all times in case of the need for emergency boarding, especially when the canister and ladder system is mounted to the back railing of the boat. It is preferable that the canister ladder system is part of a permanent installation thus making both the canister 2 and the ladder fixed and secured at all times, the latter to a cleat or eye attachment such as hook 12.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An emergency ladder system for a marine vehicle comprising:
   - a flexible ladder;
   - a container for holding said ladder in a folded condition in a stored position, said container comprising a latch for maintaining said container closed;
   - means for sturdily anchoring an upper end of said ladder to a base on the marine vehicle at a location apart from said container;
   - means for permanently mounting said container on the marine vehicle at a position wherein said container does not extend outside the bounds of the marine vehicle; and
   - means for easy opening of said container from therebelow including activation means for opening said latch by pulling downwardly whereupon said container opens and said ladder is released from said container enabling said ladder to fall into an emergency use position.

2. The emergency ladder system of claim 1 wherein said location apart from said container is a point anchor selected from the group consisting of a boat cleat, hook, and eye.

3. The emergency ladder system of claim 2, wherein said flexible ladder has a leader which exits said container through a hole in said container while in said stored position and wherein said leader is fixed to the base at said location apart from said container whereby on opening said latch said ladder falls entirely free of said container.

4. The emergency ladder system of claim 1, wherein said ladder is a rope ladder.

5. The emergency ladder system according to claim 1 wherein said container is fixed to a railing of said marine vehicle.

6. The emergency ladder system of claim 1, wherein said container is in the shape of a cylindrical canister formed of two hinged together sections, and said latch holds said hinged sections together.

7. An emergency ladder system for a marine vehicle comprising:

a flexible ladder;

a container for holding said ladder in a folded condition in a stored position;

means for sturdily anchoring an upper end of said ladder to a base on the motor vehicle at a location apart from said container; and easy opening means for easy opening of said container from a location spaced therebelow at greater than arm's reach of the container, whereupon said ladder is released from said container enabling said ladder to fall into an emergency use position, said easy opening means comprising a lanyard attached to said container and hanging downwardly therefrom a substantial distance, whereupon a person in the water at the spaced location can open said container permitting said ladder to fall into its emergency use position by pulling said lanyard downwardly.

8. The emergency ladder system of claim 7, wherein said ladder is a rope ladder.

9. The emergency ladder system of claim 7, wherein said container is in the shape of a cylindrical canister formed of two hinged together sections.

10. The emergency ladder system of claim 8, wherein said container is in the shape of a cylindrical canister.

11. The emergency ladder system of claim 10, further comprising means for fixing said canister to a railing of a boat.

12. A ladder system according too claim 7 wherein said means for easy opening comprises a latch for holding hinged sections together.

13. The emergency ladder system of claim 7, wherein said container has an upper section and a lower section hinged together along a rear portion thereof, said container further comprising a latch for connecting together front portions of said upper and lower sections and maintaining said container in a closed position, said latch being disposed along said front portions of said upper and lower sections; and means for fixedly mounting said upper section of said container to the marine vehicle, whereby said easy opening means disengages said latch thereby causing said front portion of said bottom section to rotate downwardly to release said ladder.

14. An emergency ladder system according to claim 13, wherein said lanyard is attached to a portion of said latch, whereby a downwardly pulling of said latch by pulling said lanyard effects release of said latch.

15. An emergency ladder system according to claim 14, wherein said latch comprises a removable pin releasably held in a hole within a portion of said latch, said pin preventing accidental release of said latch; and a line extending from said lanyard to said pin, whereby upon downward pulling of said lanyard said pin is withdrawn from said latch.

* * * * *